United States Patent [19]

Ishii

[11] Patent Number: 4,525,903

[45] Date of Patent: Jul. 2, 1985

[54] SLIDER FOR SLIDE FASTENER

[75] Inventor: Susumu Ishii, Kurobe, Japan

[73] Assignee: Yoshida Kogyo K.K., Tokyo, Japan

[21] Appl. No.: 439,316

[22] Filed: Nov. 4, 1982

[30] Foreign Application Priority Data

Nov. 7, 1981 [JP] Japan ..... 56-166252[U]

[51] Int. Cl.[3] ..... A44B 19/26

[52] U.S. Cl. ..... 24/429; 24/236

[58] Field of Search ..... 24/429, 237, 236

[56] References Cited

U.S. PATENT DOCUMENTS

| | | | |
|---|---|---|---|
| 1,681,550 | 8/1928 | Marinsky | 24/429 |
| 2,164,937 | 7/1939 | Morin | 24/429 |
| 2,181,142 | 11/1939 | Marinsky | 24/429 |
| 2,607,976 | 8/1952 | Zahel | 24/429 X |
| 3,444,599 | 5/1969 | Amon | 24/236 |
| 3,778,871 | 12/1973 | Ratte, Jr. | 24/236 |
| 3,955,248 | 5/1976 | Akashi | 24/429 |

*Primary Examiner*—Francis K. Zugel
*Assistant Examiner*—Peter A. Aschenbrenner
*Attorney, Agent, or Firm*—Hill, Van Santen, Steadman & Simpson

[57] ABSTRACT

A slide fastener slider has an arch-shaped lug projecting from the front end of an upper wing over the top surface of the upper wing toward the rear end thereof and terminating in a bent free end directed toward the upper wing's top surface and spaced apart therefrom by a gap s. A pull tab is threaded on the lug and thereby connected to a slider body. The slider also has a ridge projecting from the rear end of the upper wing and aligned with the arch-shaped lug longitudinally of the slider body, the ridge having a width not less than the width of the free end of the lug and having a height not less than the gap s. The ridge serves to prevent the slider from being improperly mounted on a guide, as it is fed from a hopper to the next station by a parts feeder, thereby enabling smooth feeding of the successive sliders.

1 Claim, 9 Drawing Figures

SLIDER FOR SLIDE FASTENER

BACKGROUND OF THE INVENTION

1. Field of the Invention

The present invention relates to slide fasteners, and more particularly to a slider for slide fastener.

2. Prior Art

Slide fastener sliders 10 are known which generally comprise, as shown in FIG. 6 of the accompanying drawings, a slider body 11 including upper and lower (right and left in this Figure) wings 12,13 joined at their front end 12*a* so as to define between the wings 12,13 a Y-shaped guide channel 14 for the passage of a pair of opposed coupling element rows of the slide fastener. The prior slider 10 has an arch-shaped lug 15 projecting from the front end 12*a* of the upper wing 12 over the top surface 12*b* of the upper wing and terminating short of the rear end 12*c* thereof. The lug 15 has a bent free end 15*a* directed toward the top surface 12*b* of the upper wing 12 and spaced apart therefrom by a gap described below. The lug 15 extends loosely through an opening 16*a* (FIGS. 7 and 9) of a pull tab 16, thus pivotably connecting the pull tab 16 to the slider body 11.

In assembly, the gap between the free end 15*a* of the lug 15 and the top surface 12*b* of the upper wing 12 is initially large enough to allow the pull tab 16 to be threaded on the lug 15. The lug 15, with the pull tab 16 thus mounted thereon, is then bent or deformed so as to prevent the pull tab 16 from being dismounted. During this deforming, the free end 15*a* of the lug 15 is temporarily in contact with the top surface 12*b* of the upper wing 12 when the deforming force is applied; however, the lug 15 slightly springs back due to its resiliency, when the deforming force is removed, to such an extent that the gap s is small enough to prevent the pull tab 16 from being dismounted.

Because of the gap s, the prior slider 10 has the following problem. In the manufacture of slide fasteners, sliders having been assembled are fed successively from a hopper (not shown) of known construction to the next station by a parts feeder of known construction, only a guide 17 (FIGS. 6–9) of which is illustrated for clarity. During this feeding, as shown in FIGS. 6 and 7, the successive sliders 10 (only one illustrated for clarity) are mounted astride of the guide 17, i.e. with the upper and lower wings 12,13 disposed on opposite sides of the guide 17. However, since the sliders are in disorderly position in the hopper, some of them tend to be mounted on the guide 17 in such a manner that the guide 17 extends through the gap s between the upper wing 12 and the lug's free end 15*a*, as shown in FIGS. 8 and 9. This improper mounting not only causes non-smooth feeding of the successive sliders 10 (only one illustrated for clarity), but also causes the guide 17 to be easily deformed or otherwise damaged.

Yet, if the amount of the deforming force to be applied to the lug 15 were to be increased in an attempt to minimize the gap s, the lug 15 would be so excessively deformed as to impair the pivotal movement of the pull tab 16. Further, with such an excessively deformed lug, the slider would be unsightly.

SUMMARY OF THE INVENTION

According to the present invention, a slide fastener slider has an arch-shaped lug projecting from the front end of an upper wing over the top surface of the upper wing toward the rear end thereof and terminating in a bent free end directed toward the upper wing's top surface and spaced apart therefrom by a gap s. The slider also has a ridge projecting from the rear end of the upper wing and aligned with the arch-shaped lug longitudinally of the slider body, the ridge having a width not less than the width of the free end of the lug and having a height not less than the gap s.

It is therefore an object of the invention to provide a slide fastener slider which is free from the risk of being improperly mounted on a guide of a parts feeder and hence one that can be fed smoothly, thus improving the rate of production of slide fasteners.

Another object of the invention is to provide a slide fastener slider which is free from excessive deformation of an arch-shaped lug that would impair the pivotal movement of a pull tab.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
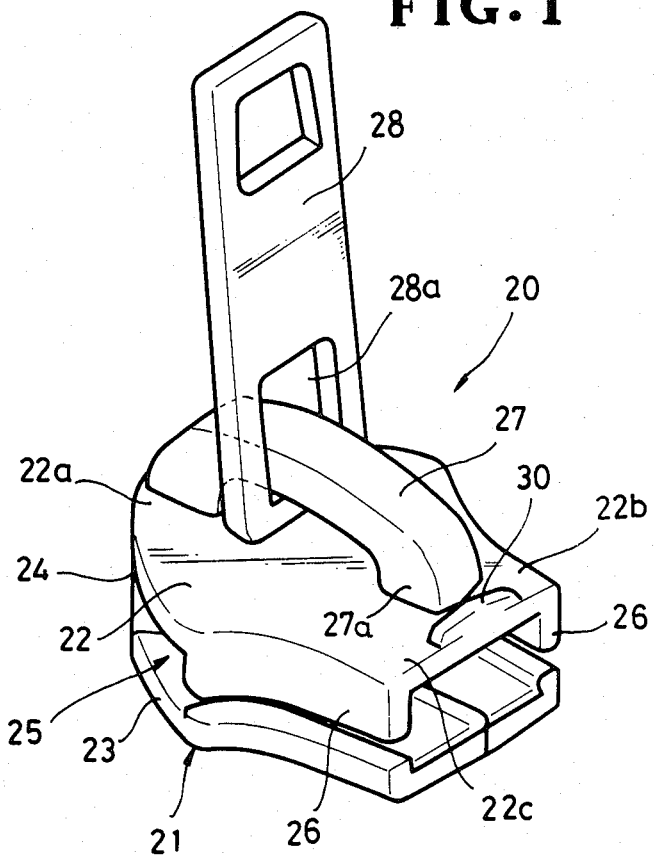
FIG. 1 is a perspective view of a slide fastener slider embodying the present invention.

The principles of the present invention are particularly useful when embodied in a slide fastener slider such as shown in FIG. 1, wholly indicated by the numeral 20.

The slider 20 comprises a slider body 21 including a pair of parallel spaced upper and lower wings 22, 23 joined at their front end by a neck 24 so as to define a Y-shaped guide channel 25 between the wings 22,23 for the passage of a pair of opposed coupling element rows of a slide fastener (not shown). The upper wing 22 has a pair of flanges 26,26 projecting respectively from opposite lateral edges thereof toward and terminating short of the lower wing 23.

The slider body 21 is made by die casting and has an arch-shaped lug 27 integral therewith and disposed on the top surface 22*b* of the upper wing 22. The arch-shaped lug 27 projects from the front end 22*a* of the upper wing 22 over the top surface 22*b* of the upper wing 22 and terminates short of the rear end 22*c* thereof. The lug 27 has a free end 27*a* directed downwardly toward the top surface 22*b* of the upper wing 22 and spaced apart therefrom by a gap s (described below). The lug 27 extends loosely through an opening 28*a* of a pull tab 28, thus pivotably connecting the pull tab 28 to the slider body 21.

Figure 2:
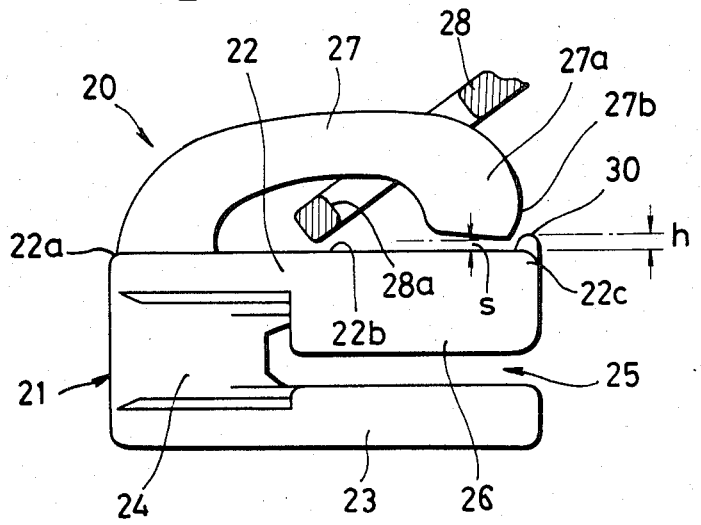
FIG. 2 is a side elevational view, partially broken away, of the slider of FIG. 1.
Figure 8:
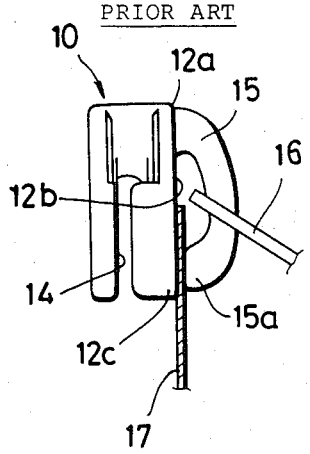
FIG. 8 PRIOR ART
Figure 9:
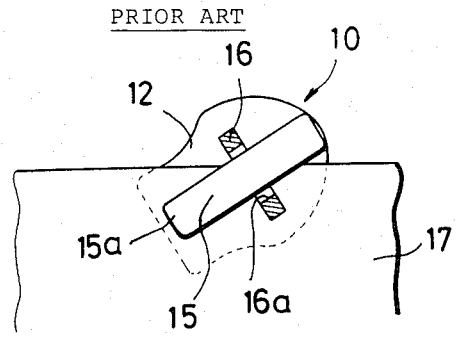
FIG. 9 PRIOR ART

Generally, in the manufacture of slide fasteners, the sliders of this type tend to be improperly mounted on a guide as they are fed from a hopper to the next station by a parts feeder, as shown in FIGS. 8 and 9. In order to eliminate this improper mounting, the slider body 21 has a ridge 30 integral therewith and projecting from the rear end 22*c* of the upper wing 22 and aligned with the arch-shaped lug 27 longitudinally of the slider body 21. The ridge 30 has a width W not less than the width w of the free end 27*a* of the lug 27 (FIGS. 3–5) and has a height h not less than the gap s and preferably slightly larger than a gap S described below (FIGS. 2, 3 and 5).

The slider body 21 is molded by die casting; therefore all surfaces perpendicular to the parting plane P (FIG. 3) are given a slight taper, or "draft", to assist removal from the mold. Specifically, the bottom surface of the lug's free end 27*a* is divided into two halves 27*a*′,27*a*′, the draft angle of which is $\theta_1$ (FIGS. 3 and 5). Likewise, the top surface 22*b* of the upper wing 22 is divided into two halves 22*b*′,22*b*′, the draft angle of which is $\theta_2$ (FIGS. 3 and 5). Thus the bottom surface half 27*a*′ and the top surface half 22*b*′ are spaced apart from one another by a maximum gap S: $S=s+e_1+e_2$, where $e_1,e_2$ represent the distances corresponding to the draft angles $\theta_1,\theta_2$, respectively. Thus, given that the slider is made by die casting, the height h of the ridge 30 is preferably slightly larger than the maximum gap S or $(s+e_1+e_2)$.

Figure 3:
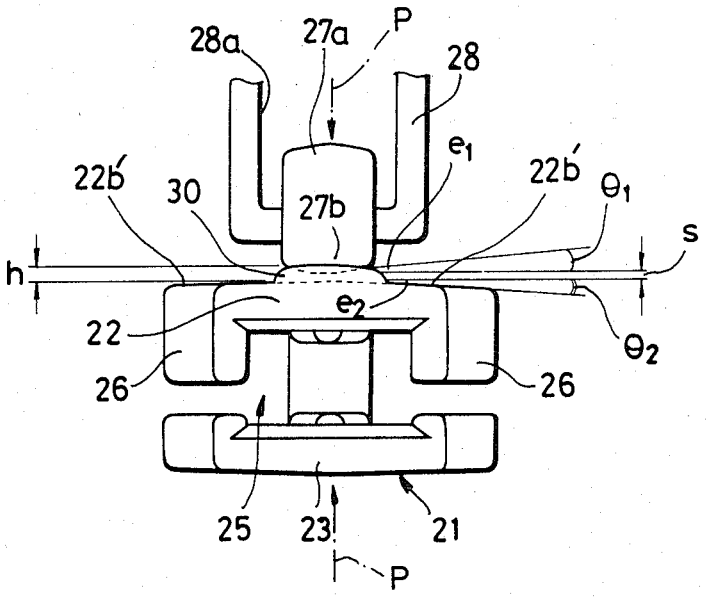
FIG. 3 is a rear elevational view, partially broken away, of the slider.
Figure 4:
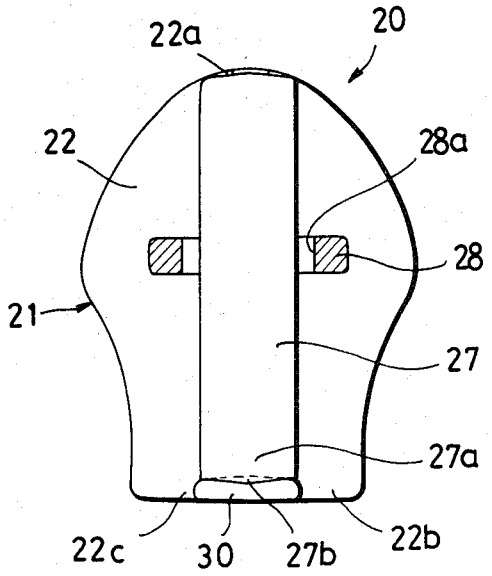
FIG. 4 is a plan view, partially in cross section, of the slider.
Figure 5:
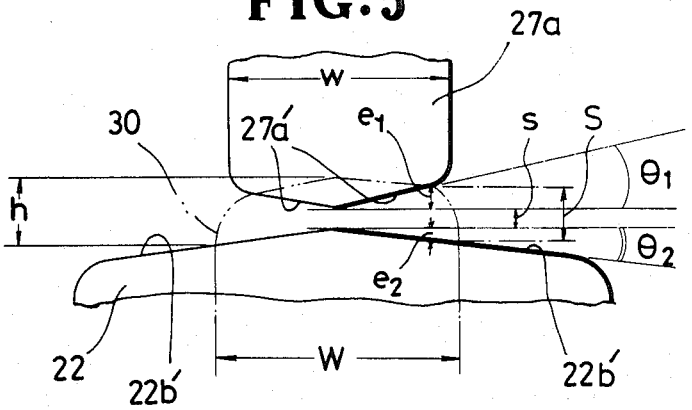
FIG. 5 is an enlarged schematic view of a portion of FIG. 3, illustrating the positional relationship between an arch-shaped lug's free end, a ridge, and an upper wing's top surface.
Figure 6:
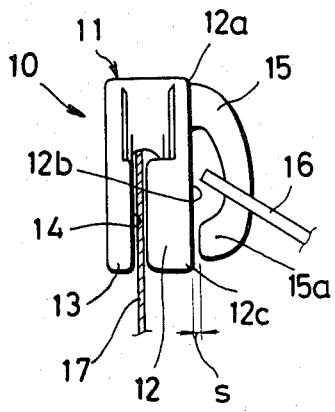
FIG. 6 PRIOR ART
FIGS. 6 through 9 illustrate a prior art slider and its problem.
Figure 7:
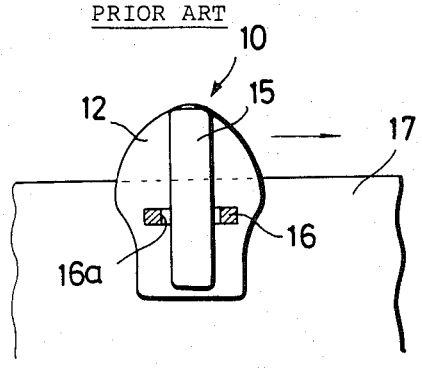
FIG. 7 PRIOR ART

The ridge 30 partially overlaps the free end 27*a* of the lug 27 as viewed in rear elevation (FIGS. 3 and 5). Further, the ridge 30 partially underlaps the rear end portion 27*b* of the lug 27 as shown in FIGS. 2 and 4.

With the slider 20 having the ridge 30, it is possible to prevent the slider 20 from being improperly mounted on a guide (FIGS. 8 and 9), as it is fed from a hopper to the next station by a parts feeder, causing smooth feeding of the successive sliders. Further, the ridge 30 serves as a stop for preventing the lug 27 from being excessively deformed during attachment of the pull tab 28 to the slider body 21.

Although various minor modifications may be suggested by those versed in the art, it should be understood that I wish to embody within the scope of the patent warranted hereon, all such embodiments as reasonably and properly come with the scope of my contribution to the art.

What is claimed is:

1. A slider for a slide fastener having a pair of opposed coupling element rows, said slider comprising:

(a) a slider body including an upper and a lower wing joined at the front ends by a neck so as to define a Y-shaped guide channel between said upper and lower wings for the passage of the coupling element rows;

(b) an arch-shaped lug disposed on a top surface of said upper wing, projecting from the front end of said upper wing and terminating longitudinally short of a rear end of said upper wing, said arch-shaped lug having a free end directed toward the top surface of said upper wing and spaced therefrom by a gap of predetermined size;

(c) a pull tab having an opening, said arch-shaped lug extending loosely through said opening to thereby pivotably connect said pull tab to said slider body; and (d) a ridge projecting from said rear end of said upper wing adjacent to said arch-shaped lug, said ridge having a width not less than the width of said free end of said arch-shaped lug and having a height not less than the size of said gap, a portion of said ridge lying to the rear of said gap extending between the rearmost end of said lug and said top surface of said upper wing.

* * * * *